US009918887B1

(12) United States Patent
Wolter, III

(10) Patent No.: US 9,918,887 B1
(45) Date of Patent: Mar. 20, 2018

(54) MEDICAL TOILET BED SYSTEM

(71) Applicant: Anthony Franklin Wolter, III, Delray Beach, FL (US)

(72) Inventor: Anthony Franklin Wolter, III, Delray Beach, FL (US)

( * ) Notice: Subject to any disclaimer, the term of this patent is extended or adjusted under 35 U.S.C. 154(b) by 10 days.

(21) Appl. No.: 15/597,892

(22) Filed: May 17, 2017

(51) Int. Cl.
*A47B 13/00* (2006.01)
*A61G 7/02* (2006.01)
*A61G 7/015* (2006.01)

(52) U.S. Cl.
CPC ..... *A61G 7/02* (2013.01); *A61G 7/015* (2013.01)

(58) Field of Classification Search
CPC ..... A61G 7/02; A61G 7/015
See application file for complete search history.

(56) References Cited

U.S. PATENT DOCUMENTS 5,513,404 A * 5/1996 Kanai ..... A61G 7/02 4/431
5,729,849 A * 3/1998 Garakani ..... A61G 7/015 5/604
5,970,529 A * 10/1999 Veal ..... A61G 9/003 4/450
6,128,790 A * 10/2000 Brayda Di Soleto .... A61G 7/02 4/480
2002/0088056 A1* 7/2002 Krempel ..... A61G 7/0005 5/604
2008/0229502 A1* 9/2008 Johnson ..... A61G 7/02 5/604
2013/0185870 A1* 7/2013 Ishida ..... A61G 7/02 5/604
2014/0068862 A1* 3/2014 Al-Jafar ..... A61G 7/02 5/605
2015/0351984 A1* 12/2015 Lu ..... A61G 7/02 5/605

* cited by examiner

*Primary Examiner* — David E Sosnowski
(74) *Attorney, Agent, or Firm* — The Concept Law Group, PA; Scott D. Smiley

(57) ABSTRACT

A medical toilet bed system including a bed frame defining a bed frame aperture and a cover coupled to the bed frame and operable to translate from an open position exposing the bed frame aperture and a closed position substantially sealing the bed frame aperture. The medical toilet bed system also includes a medical toilet configured to be disposed underneath the bed frame having a toilet seat defining a toilet seat aperture configured to substantially align with the bed frame aperture, a toilet bowl coupled to the toilet seat, and an expandable lifting member coupled to the toilet bowl. The medical toilet bed system also includes an elongated medical toilet railing disposed a distance below the bed frame and above a ground surface for receiving the medical toilet thereon.

6 Claims, 8 Drawing Sheets

MEDICAL TOILET BED SYSTEM

FIELD OF THE INVENTION

The present invention relates generally to toilets, and, more particularly, relates to a medical toilet bed system for use in a healthcare setting.

BACKGROUND OF THE INVENTION

It is well known that individuals with certain injuries and/or disabilities are unable to ambulate, or have limited mobility, restricting such individuals from being able to physically ambulate to a restroom. Some individuals may require assistance, or may be bed ridden and physically unable, to ambulate to the restroom even with assistance. Mobile devices, such as bed pans, may be brought to the individual by a caretaker, e.g., a nurse, nursing assisting, etc. This is not only embarrassing for the individual but also requires clean up by the caretaker. In addition, such mobile devices are prone to spilling and odor, and may be uncomfortable for the user.

Devices that may be attached to a standard toilet are well-known. For example, raised toilet seat risers, i.e., medical seat risers, and safety rails may be coupled to the standard toilet. Unfortunately, these devices can be cumbersome to install and may be hazardous for users. More specifically, although some individuals may be encouraged to get out of bed and visit the restroom, e.g., as part of a physical therapy regimen, such encouragement is often desirable for some only when a caretaker is present, especially for those who are at risk of falling when ambulating without assistance.

Patient hoists/lifts are known to assist individuals with getting up and/or being transferred from one location to another, such as from a patient bed to a bathroom. Unfortunately, patient lifts have their drawbacks. Many mechanical lifting aids are difficult to implement safely. Some manufacturers of mechanical lifts require that two caregivers be present when using the lift, which can be inconvenient, because hospitals and patient care facilities often implement a one patient-to-one caregiver personnel distribution. Additionally, transferring a patient using a lift can take up to 3 to 6 minutes, which is often longer than moving a patient manually. Use of mechanical lifts may also require specialized training of staff to use the lift safely. Some patients also find use of a lift to be embarrassing or less dignified. Patients may desire the ability to use the bathroom without the assistance of another individual. In addition, mechanical lifts have a weight limit at which there may be a possibility that the lift will break, which is particularly problematic for significantly overweight patients.

Therefore, a need exists to overcome the problems with the prior art as discussed above.

SUMMARY OF THE INVENTION

The invention provides a medical toilet bed system that overcomes the hereinafore-mentioned disadvantages of the heretofore-known devices and methods of this general type and that provides patients and patient care facilities with a safe and convenient alternative for facilitating patient waste care, particularly for bed-ridden patients.

With the foregoing and other objects in view, there is provided, in accordance with the invention, a medical toilet bed system including a bed frame defining a bed frame aperture; a medical toilet configured to be disposed underneath the bed frame, the medical toilet including a toilet seat defining a toilet seat aperture configured to substantially align with the bed frame aperture; a toilet bowl coupled to the toilet seat; a lifting member coupled to the toilet bowl; and a medical toilet support vehicle having an upper surface sized and shaped to support the medical toilet thereon.

In accordance with another feature, an embodiment of the present invention includes an elongated medical toilet guide member disposed a distance below the bed frame and above a ground surface for receiving the medical toilet support vehicle thereon.

In accordance with yet another feature, the medical toilet support vehicle includes at least one wheel sized and shaped to mate with the elongated medical toilet guide member.

In accordance with yet another feature, an embodiment of the present invention further includes a medical toilet storage unit adjacent the elongated medical toilet guide member, the medical toilet storage unit defining an internal housing region for housing the medical toilet therein.

In accordance with another feature, an embodiment of the present invention further includes a lifting member actuator communicatively coupled to the lifting member and disposed on a user control unit disposed within a close proximity to the bed frame.

In accordance with yet another feature, an embodiment of the present invention further includes a user support mattress removably coupled to the bed frame, the user support mattress having a removable cushion member sized and shaped to fit within the bed frame aperture.

In accordance with another feature, an embodiment of the present invention further includes a cushion member guide member coupled to the bed frame; and a cushion member support platform including an upper surface sized and shaped to receive the cushion member thereon; and a lower surface having at least one cushion member support platform wheel coupled thereto, the at least one cushion member support platform wheel slideably coupled to the cushion member guide member.

In accordance with yet another feature, an embodiment of the present invention further includes a cover coupled to the bed frame and operable to translate from an open position exposing the bed frame aperture and a closed position substantially sealing the bed frame aperture.

In accordance with a further feature, an embodiment of the present invention includes a retractable hose having a first end coupled to the toilet bowl and a second end coupled to a plumbing unit.

In accordance with another feature, an embodiment of the present invention provides for a remote controlled medical toilet bed system including a mattress support frame having a bottom portion defining a mattress support frame aperture; a medical toilet configured to be disposed beneath the mattress support frame, the medical toilet including a medical toilet seat defining a medical toilet seat aperture configured to be oriented substantially parallel to the mattress support frame aperture; and a medical toilet bowl coupled to the medical toilet seat; a medical toilet translation system couplable to the medical toilet, the medical toilet translation system including: a medical toilet support vehicle; an actuation unit coupled to the medical toilet translation system; and a drive unit coupled to the actuation unit and operably configured to translate the medical toilet support vehicle and the medical toilet from a first position to a second position, the second position different from the first position and beneath the mattress support frame.

In accordance with a further feature of the present invention, the medical toilet translation system further includes at least one horizontally disposed arm that is selectively extendable and retractable so as to translate the medical toilet support vehicle from the first position to the second position beneath the mattress support frame.

In accordance with yet another feature, an embodiment of the present invention further includes at least one fluid providing nozzle disposed within the medical toilet bowl and aimed to project a fluid in a direction toward the mattress support frame.

In accordance with yet another feature, an embodiment of the present invention further includes a lifting member having a first end and a second end opposite the first end, the first end coupled to the medical toilet bowl and the second end coupled to the medical toilet support vehicle.

In accordance with yet another feature, an embodiment of the present invention further includes a user support mattress in an overlapping relationship with the mattress support frame, the user support mattress having a removable portion coupled to the actuation unit.

In accordance with yet another feature, an embodiment of the present invention further includes a conveyor having a first end and a second end disposed a longitudinal length from the first end, the first end may terminate within a medical toilet storage unit and the second end may terminate beneath the mattress support frame aperture.

In accordance with yet another feature, an embodiment of the present invention further includes a medical toilet housing having a sidewall defining a housing opening sized to receive the medical toilet through the housing opening as it is translated from the second position to the first position.

In accordance with another feature, an embodiment of the present invention provides for a medical toilet bed system with a medical toilet housing unit including at least one sidewall, the at least one sidewall at least partially defining an interior medical toilet storage chamber; and a medical toilet exit region spanning substantially from a ground surface in a direction toward a ceiling; a medical toilet translation system having at least one support arm disposed in a horizontal direction parallel to a ground surface, the at least one support arm including at least one end disposed within the medical toilet housing unit; a medical toilet having a height less than a height of the medical toilet exit region; and a bed frame defining a bed frame aperture configured to be in an overlapping relationship with the medical toilet.

In accordance with yet another feature, an embodiment of the present invention further includes a retractable hose having a first end coupled to the medical toilet and a second end coupled to a plumbing unit located within the medical toilet housing.

In accordance with yet another feature, an embodiment of the present invention further includes a user support mattress disposed on a top surface of the bed frame, the user support mattress having a removable cushion member substantially smaller than the user support mattress.

In accordance with another feature, an embodiment of the present invention further includes a medical toilet flush actuator communicatively coupled to a user control unit disposed within a close proximity to the bed frame.

Although the invention is illustrated and described herein as embodied in a medical toilet bed system, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the object, e.g., conveyer. The terms "program," "software application," and the like as used herein, are defined as a sequence of instructions designed for execution on a computer system. A "program," "computer program," or "software application" may include a subroutine, a function, a procedure, an object method, an object implementation, an executable application, an applet, a servlet, a source code, an object code, a shared library/dynamic load library and/or other sequence of instructions designed for execution on a computer system.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
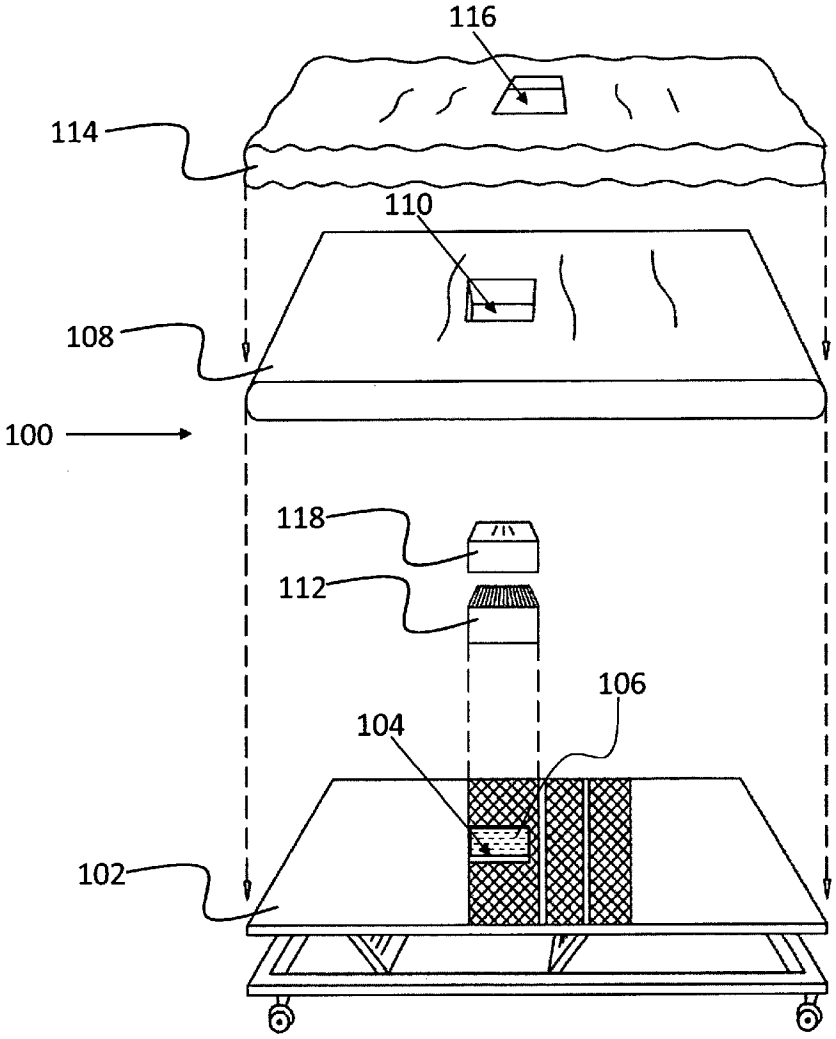
FIG. 1 is an expanded elevational side view of a bed, in accordance with an embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient medical toilet bed system that provides a user the ability to utilize a toilet from a bed, e.g., a hospital bed, without physically ambulating to a traditional restroom toilet. In one embodiment, the medical toilet bed system includes a bed frame and a support mattress having concealable apertures that may be uncovered when the user desires to utilize the toilet. Embodiments of the invention also provide the user with the ability to utilize a remote control unit to move the medical toilet along a medical toilet railing disposed below a bed frame in order to effectively conceal the toilet from public view when not in use. In addition, embodiments of the invention provide at least one fluid providing nozzle disposed within the medical toilet bowl that effectively washes and/or dries the user's bottom for sanitary purposes.

Referring now to FIG. 1, one embodiment of the present invention is shown in an elevational side view. FIG. 1 shows several advantageous features of the present invention, but, as will be described below, the invention can be provided in several shapes, sizes, combinations of features and components, and varying numbers and functions of the components. The first example of a medical toilet bed system 100, as shown in FIG. 1, includes a bed frame 102, i.e., mattress support frame, defining a bed frame aperture 104, i.e., mattress support frame aperture. Advantageously, the bed frame 102 can be seen having a cover 106 coupled to the bed frame 102 and operable to translate from an open position exposing the bed frame aperture 104 and a closed position substantially sealing the bed frame aperture 104. The term "substantially sealing" is defined herein as covering at least 75% of the overall area of the bed frame aperture 104. In one embodiment, the cover 106 is a door having a hinge. In another embodiment, the cover 106 may be a flap or another piece of moveable material that swings or slides open and shut. In one embodiment, the bed frame 102 can be made of a metallic material, such as, for example, steel. In another embodiment, the bed frame 102 can be made of another rigid material sufficient to provide support for a user and a mattress.

When the cover 106 is placed in the open position, waste is permitted to travel through the bed frame aperture 104 to a toilet disposed below the bed frame aperture 104, as discussed in more detail below. In the closed position, the cover 106 provides support to a user support mattress 108, the user support mattress 108 being provided in an overlapping relationship with the bed frame 102, thereby preventing the user support mattress 108 from sinking through the bed frame aperture 104. In one embodiment, similar to the bed frame aperture 104, the user support mattress 108 is depicted defining a user support mattress aperture 110. The user support mattress aperture 110 may be concealed by a removable portion 112, e.g., a cushion that is coupled to the user support mattress 108 by a snap configuration, a hook and loop fastener, etc. In other embodiments, the removable portion 112 may be a cutout portion of the user support mattress 108. In another embodiment, the bed frame 102 can be considered to include a top surface on which the user support mattress 108 is supported.

The user support mattress 108 can be seen having a user support mattress cover 114, e.g., a fitted sheet, sized and shaped to couple to the user support mattress 108. Advantageously, the user support mattress cover 114 defines a user support mattress cover aperture 116 configured to align with the user support mattress aperture 110 and the bed frame aperture 104 to effectively allow waste to travel through the apertures 104, 110, 116 into the medical toilet when positioned beneath the apertures 104, 110, 116. The user support mattress cover aperture 116 may translate from an open position to a closed position through the use of a detachable portion 118. In a preferred embodiment, the detachable portion 118 is configured to couple to the removable portion 112, so that both components may be effectively removed simultaneously for user convenience. In one embodiment, the removable portion 112 can be considered a removable cushion member that is sized and shaped to fit within the bed frame aperture 104. In another embodiment, the detachable portion 118 can be considered a fitted sheet that is sized and configured to fit over the removable portion 112. In one embodiment, the removable portion 112 is of the same cushion material as the user support mattress 108 so as to provide continuous cushioning support for the user. In another embodiment, the detachable portion 118 is of the same material as the user support mattress cover 114 (e.g., a cotton material or other similar bedding material) so as to provide a seamless covering for the user support mattress 108.

In one embodiment, the removable portion 112 is substantially smaller than the user support mattress 108. As used herein, the term "substantially smaller" is defined as at most 35% of the total surface area of the referenced object, in this case, the user support mattress 108. In one embodiment, the removable portion 112 and the detachable portion 118 together are manually removable from the apertures 110 and 116 so as to allow a fluid flow pathway for waste from the user to the toilet beneath the bed frame 102. In another embodiment, the removable portion 112 and the detachable portion 118 together are mechanically removable from the apertures 110 and 116, as described in more detail herein below.

Figure 2:
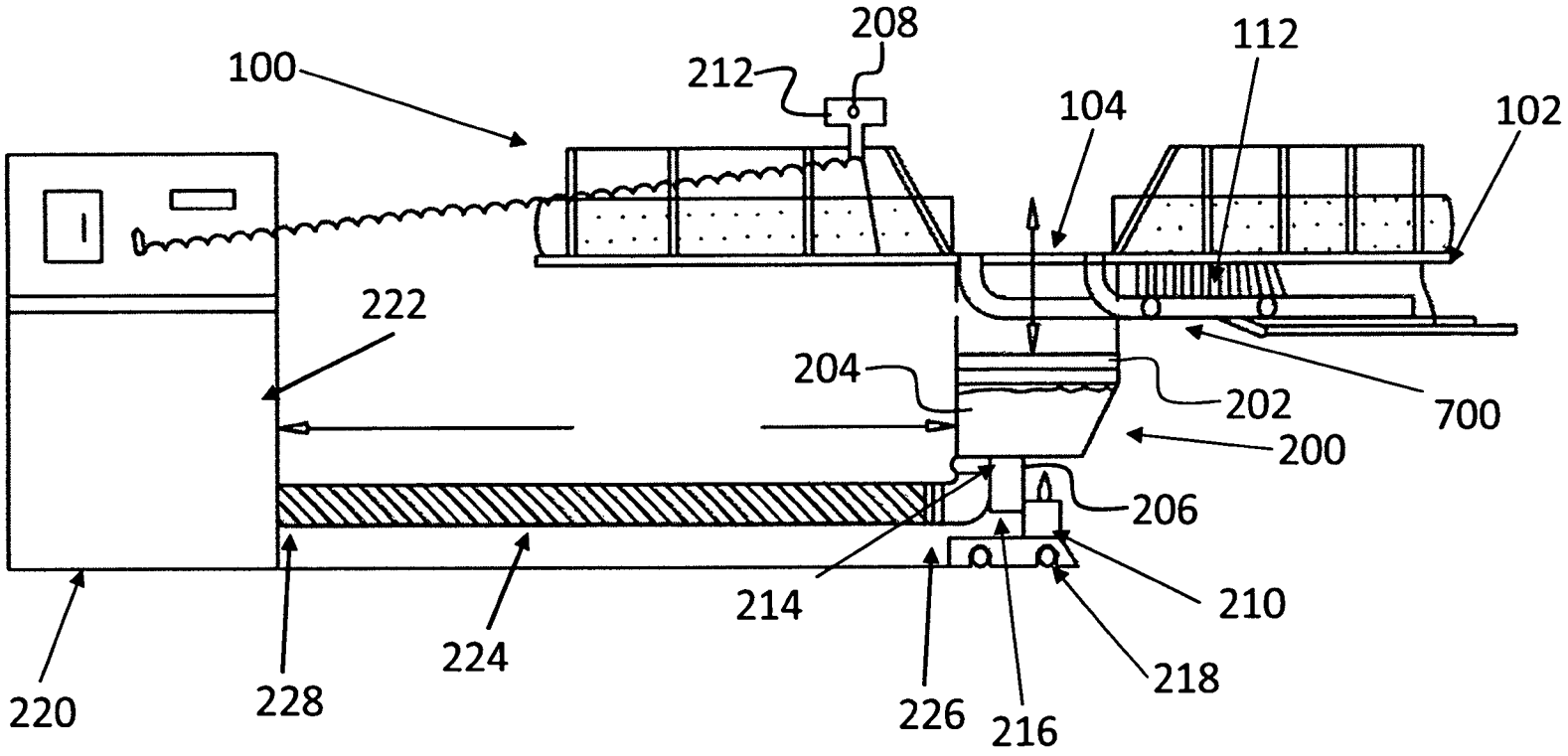
FIG. 2 is a an elevational side view of an exemplary medical toilet bed system with a medical toilet disposed underneath a bed frame, in accordance with the present invention.

With reference now to FIG. 2, which depicts an elevational side view of the medical toilet bed system 100, a medical toilet 200 can be seen disposed underneath the bed frame 102. In one embodiment, the medical toilet 200 includes a toilet seat 202 coupled to a toilet bowl 204. In another embodiment, the bed frame aperture 104 defined by the bed frame 102 is configured to be in an overlapping relationship with the toilet bowl 204. With brief reference to FIG. 2, in conjunction with FIG. 3, the toilet seat 202 defines a toilet seat aperture 300 (FIG. 3) configured to substantially align with the bed frame aperture 104 (FIG. 2) so as to define a fluid flow pathway for user waste through the bed frame aperture 104 and the toilet seat aperture 300. In one embodiment, the toilet seat aperture 300 is configured to be oriented substantially parallel to (0 degree, +/−10 degrees) and substantially overlapping with (90% overlap+/−15%) the bed frame aperture 104. In one embodiment, the toilet bowl 204 may be made of a rigid fluid impermeable material, such as for example ceramic, steel, polystyrene, plastic, or other polymer-based composites. In another embodiment, the toilet seat 202 may include a relatively soft cushion material for user comfort.

Figure 3:
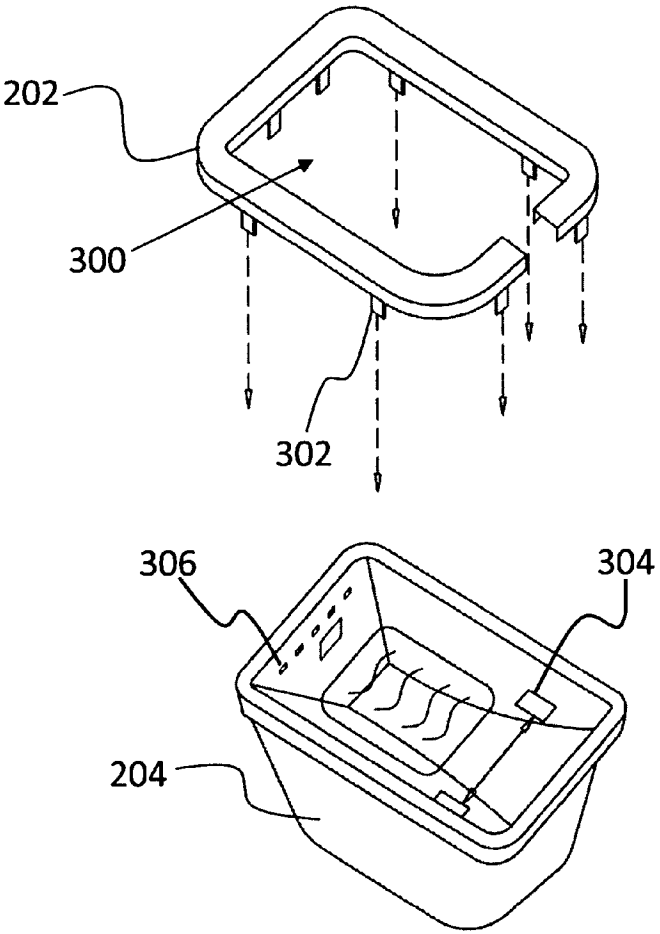
FIG. 3 is a downward looking perspective view of a toilet bowl, in accordance with an embodiment of the present invention.

FIG. 3 depicts the toilet seat 202 having a plurality of projections 302 extending in a downward direction from a bottom surface of the toilet seat 202 toward a ground surface. The projections 302 effectively facilitate the coupling of the toilet seat 202 with the toilet bowl 204. More specifically, in one non-limiting embodiment, the projections 302 allow the toilet seat 202 to snap onto the toilet bowl 204. Advantageously, this embodiment not only provides a caretaker with the ability to easily and conveniently remove the toilet seat 202 for cleaning, but it also provides the caretaker with the ability to quickly and efficiently couple the toilet seat 202 to the toilet bowl 204 when desired. Such advantageous embodiment also allows the toilet seat 202 to be quickly and easily discarded when the toilet seat 202 is disposable. The term "disposable" is defined herein as intended to be used 1-3 times and then thrown away. Such configuration may be especially advantageous for each new patient assigned to a particular hospital bed within a hospital setting.

In one embodiment, to wash the user's genital and anal area, the toilet bowl 204 may advantageously include at least one fluid dispensing nozzle 304 disposed within the toilet bowl 204 aimed to project a fluid in a direction toward the bed frame 102 (FIG. 2). In one embodiment, the fluid dispensing nozzle 304 may be operably configured to project fluid with a sufficient amount of fluid pressure to clean solid waste that may be adhered to the user's anal area as a result of a bowel movement. In another embodiment, there may be provided a plurality of fluid dispensing nozzles 304. In yet another embodiment, the plurality of fluid dispensing nozzles 304 may be oriented so as to project fluid in a plurality of directions. In a preferred embodiment, the fluid dispensing nozzle 304 is coupled to a sensor configured to activate the fluid dispensing nozzle 304 following the flushing of the medical toilet 200. In one embodiment, the fluid dispensing nozzle 304 may dispense fluid for a pre-programmed time period, e.g., 20-40 seconds. At the close of the pre-programmed time period, a plurality of air dispensing nozzles 306, coupled to a second sensor, may be activated to effectively dry the user's genital and anal area. Similar to the fluid dispensing nozzles 304, the air dispensing nozzles 306 may dispense air for a pre-programmed time period. In one embodiment, the air dispensing nozzle 306 may dispense heated air for user comfort and enjoyment. As used herein, the term "fluid" is intended to indicate liquid fluid (e.g., toilet water) and the term "air" is intended to indicate gaseous fluid (e.g., dryer air).

In order to prevent the water within the toilet bowl 204 from overflowing, the toilet bowl 204 may include a first marking representing an overflow line and a second marking, beneath the first marking, representing a water line level. The toilet bowl's 204 fluid management system may be configured so as to maintain a fluid level at or substantially adjacent to the water line level. Advantageously, maintaining fluid in the toilet bowl 204, before and after flushing, prevents bad odor and helps to prevent overflow conditions. In a further embodiment, the toilet bowl's 204 fluid management system may include a sensor operably configured to detect fluid at or substantially adjacent to the overflow line. If the sensor detects such an overflow condition, the sensor may cause the fluid management system to output an alert (e.g., red light indicator, vibration, audio alert) to alert the user or hospital support staff as to the condition. Alternatively, or in addition, if the sensor detects such an overflow condition, the sensor may cause the fluid management system to automatically actuate a shut-off valve to halt water flow until the condition can be rectified.

In one embodiment, the medical toilet bed system 100 may include a waste removal component, such as, for example, a toilet bowl incinerator. In a further embodiment, the toilet bowl incinerator may be disposed within the toilet bowl 204 so as to substantially eliminate waste therein.

With reference again to FIG. 2, in order to effectively lower and raise the medical toilet 200 with respect to the bed frame 102, the medical toilet 200 includes a lifting member 206 coupled to the toilet bowl 204.

In one embodiment, in order to control the lowering and raising of the medical toilet 200 with respect to the bed frame 102, a lifting member actuator 208 is communicatively coupled to an electric motor 210. As used herein, the term "actuator" is defined as a mechanical or electromechanical device for moving or controlling something. Known actuators include a button, a switch, a lever, a slide, etc. In one embodiment, in order for the lifting member actuator 208 to be controlled by the user, the lifting member actuator 208 is located on a control unit 212 disposed within a close proximity, e.g., within 1-2 feet, of the bed frame 102. In another embodiment, the control unit 212 may be disposed greater than 1-2 feet of the bed frame, for example, on a wall or other structural unit. In other embodiments, the control unit 212 may be disposed in a remote location and operated by a caretaker, e.g., hospital personnel. The control unit 212 may be communicatively coupled (wired or wireless connection) to the electronic and/or mechanical components that cause the lifting member 206 to translate in a vertical direction upwards toward the bed frame 102 and downwards toward the ground surface. A wireless connection may be used in some embodiments so as to avoid the hassle of physical wires. On the other hand, a wired connection may be preferable in some embodiments so as to avoid interference with other wireless signals used by other hospital equipment.

Figure 4:
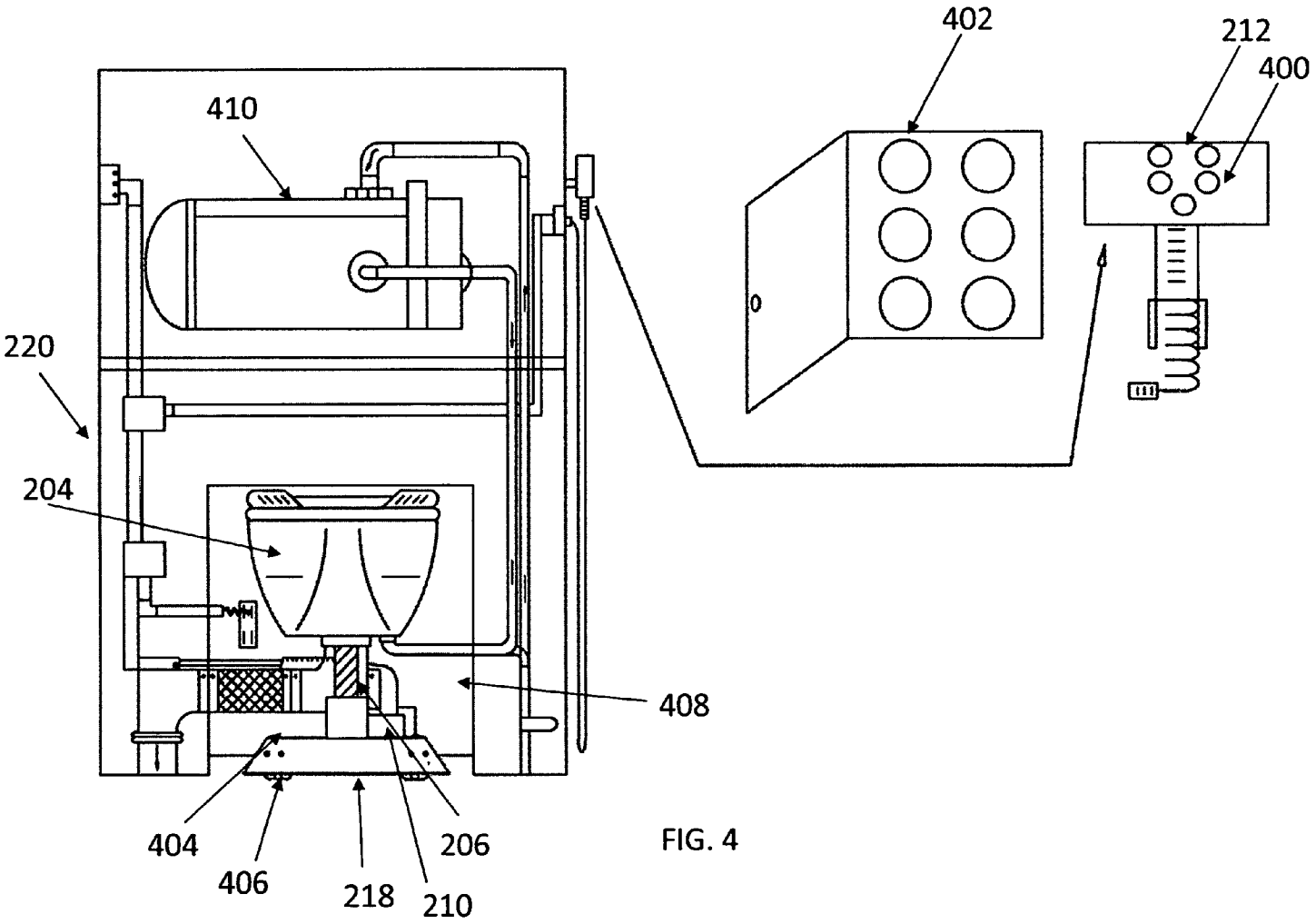
FIG. 4 is a schematic view of a toilet bowl housing system and remote control system, in accordance with an embodiment of the present invention.

Turning now briefly to FIG. 4, the control unit 212 may be formed as a hand-held patient remote control, as depicted in FIG. 4. In one embodiment, the control unit 212 may be a touchscreen computer tablet, with the controls operable by way of user input via the touchscreen. In another embodiment, the control unit 212 may resemble a television remote control with a plurality of control buttons. More specifically, the control unit 212 may include a plurality of actuators 400 that allow a user to control various functions of the medical toilet bed system 100. In one embodiment, the control unit 212 may be communicatively coupled to a medical toilet flush actuator to allow the user to remotely flush the toilet bowl 204. In other embodiments, the control unit 212 may include actuators 400 for one or more of the following functions: flushing, dispensing air via the air dispensing nozzles 306, dispensing fluid from the fluid dispensing nozzles 304, mechanically lifting the toilet bowl 204 via the lifting member 206, mechanically lowering the toilet bowl 204 via the lifting member 206, turning the medical toilet bed system 100 on and off, and opening and closing a door to a toilet bowl 204 housing (explained in more detail herein below). In further embodiments, the control unit 212 may be communicatively coupled to other types of actuators that control further functions of the medical toilet bed system 100. In another embodiment, the controls for the system 100 may be formed as a remote control unit 402 configured for control by hospital or other medical care facility staff. In some embodiments, the remote control unit 402 may include the same controls as in the control unit 212 for the patient. In other embodiments, the remote control unit 402 may include more or less controls than the control unit 212 for the patient. Advantageously, the control units 212, and 402 allow the user to use the toilet from his bed, without having to get up and/or without requiring the assistance of another individual, which provides a measure of privacy and dignity for those temporarily or permanently bedridden individuals. In addition, medical personnel may direct their time towards other useful activities, rather than attending to patients' periodic and daily bathroom and waste assistance, which can consume a significant amount of time.

Returning now to FIG. 2, in one embodiment, the lifting member 206 may have a first end 214 and a second end 216 opposite the first end 214. In a further embodiment, the first end 214 may be coupled to the toilet bowl 204 and the second end 216 may be coupled to a medical toilet support vehicle 218, which will be described in more detail herein below.

In one embodiment, the lifting member 206 is generally powered by the electric motor 210 and may include an elevator system with traction cables and pulleys running between the toilet bowl 204 and the electric motor 210. In a further embodiment, the toilet bowl 204 may be coupled to a traction cable and the traction cable may loop around a pulley that is powered by the electric motor 210. The electric motor 210 may cause the pulley to rotate, which moves the traction cables so as to raise or lower the toilet bowl 204 attached thereto. In other embodiments, the lifting member 206 may be formed as a hydraulic lift system that uses pressurized hydraulic oil to raise and lower the toilet bowl 204. In yet another embodiment, the lifting member 206 may include a scissor lift. As is known in the art, scissor lifts can be hydraulic, pneumatic, mechanical, and/or electrical. In yet another embodiment, the lifting member 206 may include a plurality of telescoping rods that are powered by the electric motor 210 to raise and lower the toilet bowl 204 toward and away from the bed frame 102. In yet other embodiments, the lifting member 206 may be formed as other types of hydraulic, pneumatic, mechanical, and/or electrical lift systems. In one embodiment, the lifting member 206 may be operably configured to raise the toilet bowl 204 up to about 18 inches from the floor surface. In another embodiment, the lifting member 206 may be operably configured to raise the toilet bowl 204 up to a maximum height of 3 feet from the floor surface. In yet another embodiment, the lifting member 206 may be operably configured to raise the toilet bowl 204 up to a maximum height of the bed frame 102, or slightly shorter than the maximum height of the bed frame 102. In yet another embodiment, the lifting member 206 may be operably configured to lower the toilet bowl 204 so that the toilet bowl 204 can be cleared for entrance into a medical toilet bowl storage unit 220 disposed adjacent to the bed frame 102. The medical toilet bowl storage unit 220 can be considered a housing for the toilet bowl 204 so as to conceal the toilet bowl 204 from external view, when not in operational use. Stated another way, the medical toilet bowl storage unit 220 defines an internal housing region 222 for housing the toilet bowl 204 therein. In one embodiment, the medical toilet bowl storage unit 220 can be a housing structure separate from and/or independent from a building wall of the medical care facility. In other words, the medical toilet bowl storage unit 220 may be disposed a separation distance from the building walls defining the interior of the patient's room. In another embodiment, the medical toilet bowl storage unit 220 can be integrated with the building wall of the medical care facility and disposed within the building wall, such as a closet or other similar integrated structure.

Referring again primarily to FIG. 2, the medical toilet bed system 100 includes a medical toilet translation system couplable to the toilet bowl 204. The medical toilet translation system can be considered the system or device that allows the toilet bowl 204 to translate or move between the medical toilet bowl storage unit 220 (which houses and conceals the toilet bowl 204 from external view when not in operational use) and the area beneath the bed frame aperture 104, so that the toilet bowl 204 can be used by the user to eliminate waste and clean the genital and anal area thereafter, while the user remains in bed. The medical toilet translation system may be implemented in a variety of ways to translate the toilet bowl 204. Described below is a plurality of non-limiting exemplary embodiments.

In one embodiment, the medical toilet translation system may include the medical toilet support vehicle 218. In one embodiment, the medical toilet support vehicle 218 can be considered a structure used to transport the toilet bowl 204 from one location to another location. In a further embodiment, the medical toilet support vehicle 218 may include a motor or engine that powers movement of the medical toilet support vehicle 218. In other words, the medical toilet support vehicle 218 may be formed as a motor vehicle, and, in some embodiments, an electric motor vehicle. In other embodiments, movement of the medical toilet support vehicle 218 may be implemented by other translation mechanisms. For example, the medical toilet support vehicle 218 may be pulled and pushed by a mechanical translation arm coupled thereto.

Referring now briefly to FIG. 4, in one embodiment, the medical toilet support vehicle 218 may have an upper surface 404 sized and shaped to support the toilet bowl 204 and/or the lifting member 206 thereon. The medical toilet support vehicle 218 may be made of a rigid material, such as a rigid plastic material, sufficient to support the toilet bowl 204 and the lifting member 206 thereon. In another embodiment, the medical toilet support vehicle 218 may have at least one wheel 406 to assist with allowing the medical toilet support vehicle 218 to move between the medical toilet bowl storage unit 220 and an area directly beneath the bed frame aperture 104 (FIG. 1). In one embodiment, an actuation unit may be coupled to the medical toilet translation system. More specifically, in one embodiment, the actuation unit may be coupled (wired or wirelessly) to the medical toilet support vehicle 218 so as to provide a control to initiate translational movement of the toilet bowl 204. In one embodiment, the control unit 212 or 402 may be considered an actuation unit. In another embodiment, the actuation unit may be provided in another form, such as, for example, a switch, a lever, a push button, or the like. In one embodiment, the actuation unit may be coupled to a drive unit operably configured to translate the medical toilet support vehicle 218 and the toilet bowl 204 from a first position to a second position beneath the bed frame 102 (FIG. 1). The second position may be considered different from the first position. Stated another way, the second position is disposed a separation distance from the first position. In one embodiment, the electric motor 210 of the medical toilet support vehicle 218 may be considered a drive unit. As used herein, the term "drive unit" is intended to indicate a device or machinery used to drive movement for the medical toilet translation system. Generally, the actuation unit may be considered a mechanism by which the user may initiate movement, which movement is executed by the drive unit as a result of the user input via the actuation unit.

Referring now again primarily to FIG. 2, in one embodiment, the medical toilet translation system can include at least one support arm 224 that is selectively extendable and retractable so as to translate the medical toilet support vehicle 218 from the first position to the second position beneath the bed frame 102. The support arm 224 may be made of a relatively robust material sufficient to support the medical toilet support vehicle 218 and the toilet bowl 204, such as, for example, a metallic material, plastic, or other polymer-based material, and the like. In another embodiment, the support arm 224 is horizontally disposed relative to the ground surface. Stated another way, the support arm 224 may be considered parallel with the ground surface. In yet another embodiment, the support arm 224 is substantially horizontally disposed relative to the ground surface, i.e., substantially parallel (0 degrees+/−10 degrees) with the ground surface. An end of the support arm 224 may be housed within the medical toilet bowl storage unit 220 and an opposite end of the support arm 224 may be coupled to the toilet bowl 204 and/or the medical toilet support vehicle 218. In another embodiment, the support arm 224 can be formed as a telescoping rod that is horizontally oriented relative to the ground surface. The telescoping rod may be coupled to a motor that allows the rod to telescopically translate so as to selectively vary its length. In a further embodiment, the support arm 224 may be coupled to one or more wheels on a bottom surface thereof to rollingly support the support arm 224 on the ground surface for easier translation between the housing and bed frame 102.

In one embodiment, the support arm 224 can be formed as a retractable hose 224. In one embodiment, the retractable hose 224 may be made of a flexible material so as to be compressible in overall length for storage within the medical toilet bowl storage unit 220, when not in operational use. In another embodiment, the retractable hose 224 may be made of a durable material, such as rubber or other robust polymer-based material, so that it can be retracted and extended on a daily basis without significant wear and tear. In a further embodiment, the retractable hose 224 may be made of a fluid impermeable material to allow fluid and waste to flow therethrough without leakage. In one embodiment, the retractable hose 224 may include one or more internal tubes or hoses to facilitate plumbing for the toilet bowl 204. The one or more internal tubes may be concentric with the retractable hose 224. In a further embodiment, the one or more internal hoses may include a water-inlet hose to supply water to the toilet bowl 204 and a waste outlet hose to allow fluid and solid waste to exit the toilet bowl 204. The water-inlet hose may be coupled to a water supply and the waste outlet hose may be coupled to a waste tank or system, which may be provided within the medical toilet bowl storage unit 220, or, in some embodiments, elsewhere within the building. In yet a further embodiment, the one or more internal tubes may include an air inlet tube for transporting air to the air dispensing nozzles 306 (FIG. 3). In this embodiment, an air supply tank may be housed within the medical toilet bowl storage unit 220. In an alternative embodiment, the air supply tank may be provided on the medical toilet support vehicle 218 so as not to require an additional air inlet tube to be routed through the retractable hose 224 from the medical toilet bowl storage unit 220.

Still referring to FIG. 2, with brief reference to FIG. 4, in one embodiment, the retractable hose 224 may have a first end 226 coupled to the toilet bowl 204 and a second end 228, opposite the first end 226, coupled to a plumbing unit 408. In another embodiment, the first end 226 of the retractable hose 224 may be directly coupled to the medical toilet support vehicle 218. In one embodiment, at least a portion of the plumbing unit 408 may be housed within the medical toilet bowl storage unit 220. In another embodiment, the entire plumbing unit 408 associated with the medical toilet bed system 100 may be housed within the medical toilet bowl storage unit 220, or, more specifically, housed within the medical toilet bowl storage unit 220 when in a storage configuration, i.e., when not in operational use beneath the bed frame aperture 104 or in transition towards the bed frame aperture 104 (FIG. 1). In yet another embodiment, a substantial portion (at least 90%+/−5%) of the plumbing unit 408 associated with the medical toilet bed system 100 may be housed within the medical toilet bowl storage unit 220, when in the storage configuration. In another embodiment, at least a portion of the plumbing unit 408 may include plumbing fixtures associated with the building's plumbing system. In yet another embodiment, the plumbing unit 408 may include a series of pipes, drainages, fixtures, water tanks, waste tanks, water/air/waste inlet and outlet tubes, and the like, as discussed in the immediately preceding paragraph, and as generally known in the plumbing arts.

It is understood that the retractable hose 224 is both retractable and extendable. In one embodiment, the retractable hose 224 may extend outwardly from the medical toilet bowl storage unit 220 to the area beneath the bed frame aperture 104 (FIG. 1). In a further embodiment, the retractable hose 224 (or other configuration of the medical toilet translation system) may extend outwardly a distance of at least about 18 inches from the medical toilet bowl storage unit 220 to the area beneath the bed frame aperture 104 (FIG. 1). The retractable hose 224 may be selectively extendable or retractable as a result of a user input, via, for example, the control unit 212. The retractable hose 224 may be extendable and retractable by any known mechanism, such as by an electrical system, hydraulic system, mechanical system, pneumatic system, and the like.

Figure 5:
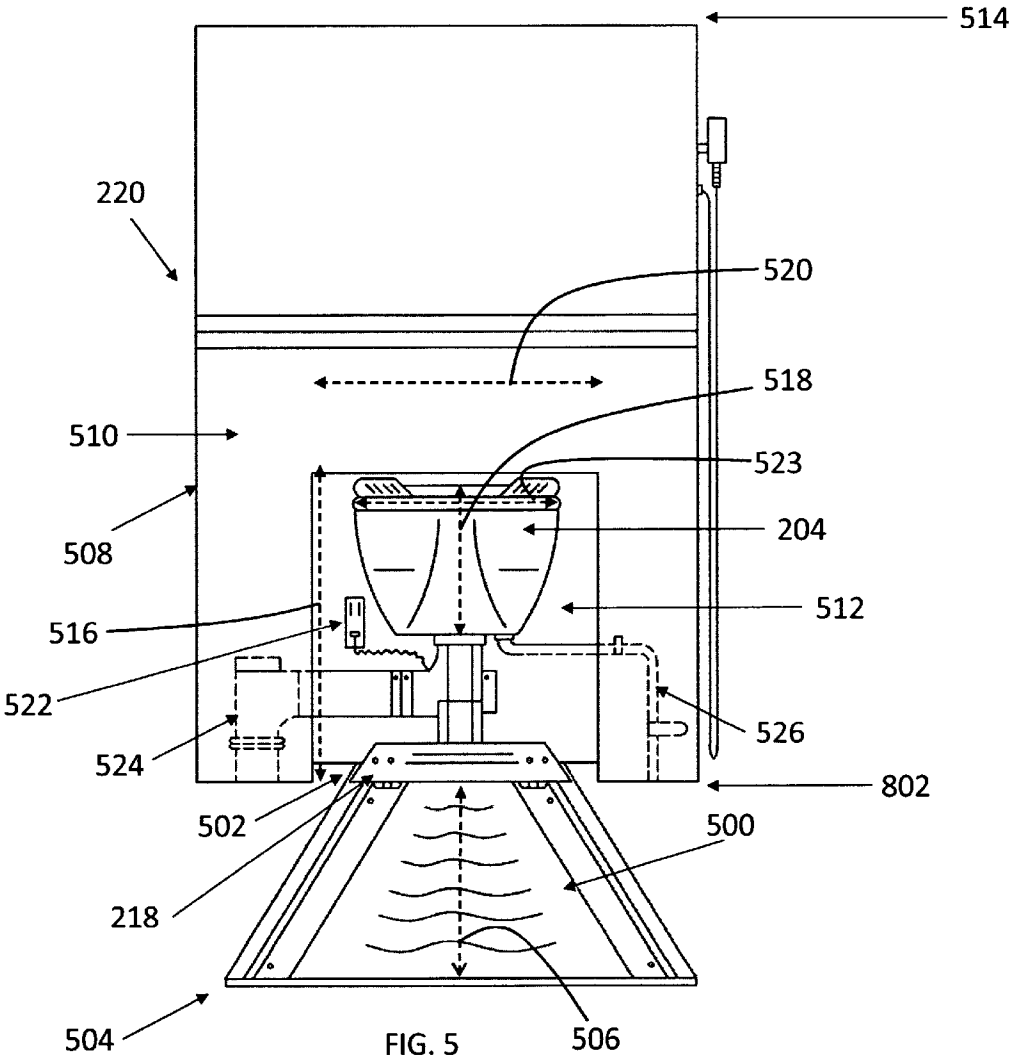
FIG. 5 is a front elevational view of the toilet bowl housing system, in an open configuration, in accordance with an embodiment of the present invention.

Referring now briefly to FIG. 5, the medical toilet translation system may include a conveyor 500. As used herein, the term "conveyer" is intended to indicate an elongated strip of material that can move in a continuous manner and, at the same time, carry the toilet bowl 204 thereon from one position to another position. In one embodiment, the conveyer 500 may include a rubber or canvas material. In another embodiment, the conveyer 500 may be made of other materials. In a further embodiment, the conveyer 500 may include a conveyer belt supported on a rotational device so as to drive rotation of the conveyer belt. In one embodiment, the conveyer 500 may have a first end 502 and a second end 504 disposed a longitudinal length 506 from the first end 502. The longitudinal length 506 can be considered a length in the elongation direction of the conveyer 500. The first end 502 may terminate within the medical toilet bowl storage unit 220 and the second end 504 may terminate beneath the bed frame aperture 104 (FIG. 2).

Figure 8:
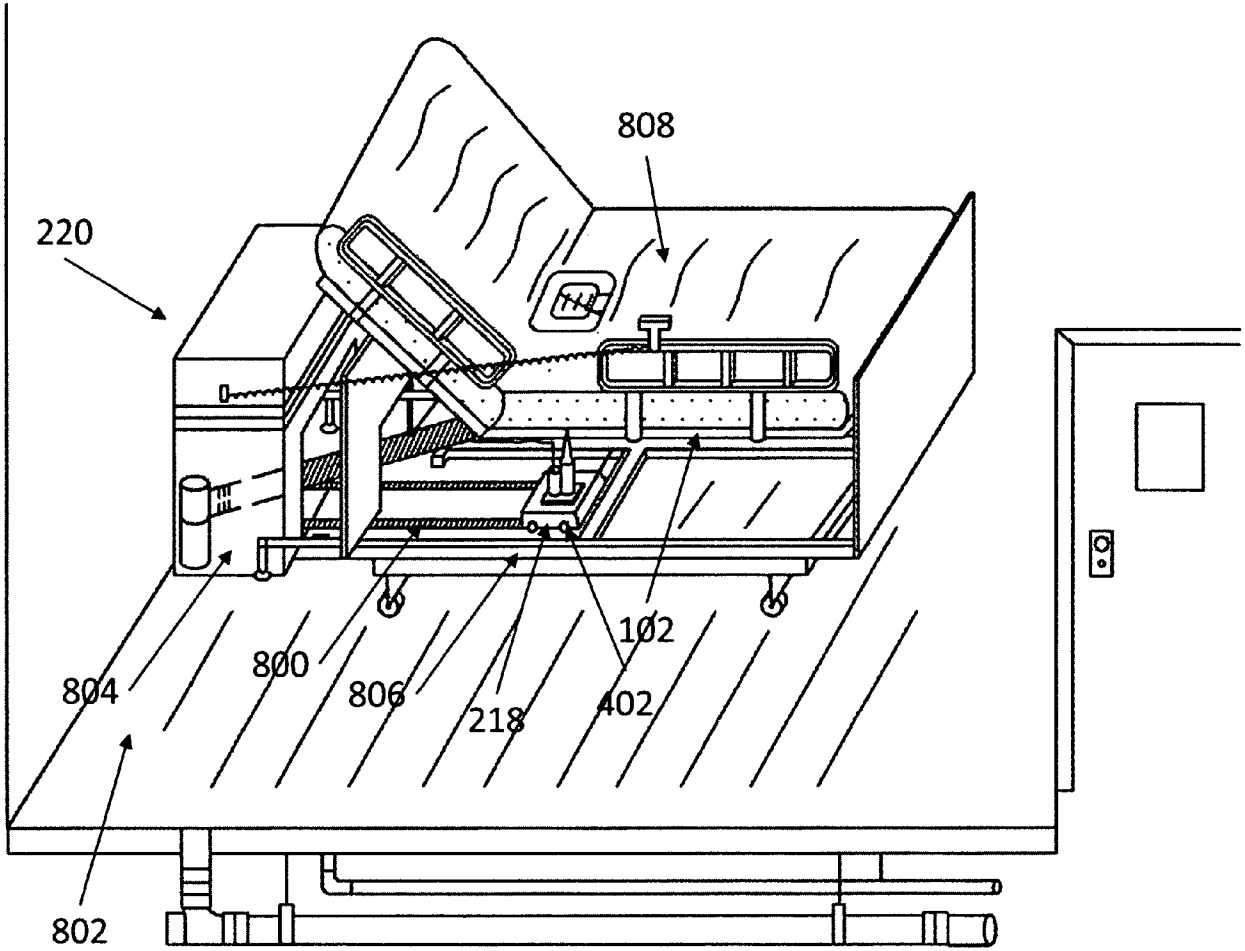
FIG. 8 is a perspective side view the medical toilet bed system housed within a room of a building in accordance with an embodiment the present invention.

Referring now briefly to FIG. 8, the medical toilet translation system may include an elongated medical toilet guide member 800 disposed a distance below the bed frame 102 and above a ground surface 802 for receiving the medical toilet support vehicle 218 thereon. As used herein, the term "elongated medical toilet guide member" is intended to indicate a structure that directs the movement of the medical toilet support vehicle 218, or another structure that moves the toilet bowl 204 (not shown), from a first location associated with a storage configuration to a second location beneath the bed frame 102 that is associated with a usage configuration. In one embodiment, the elongated medical toilet guide member 800 may be considered a track. In another embodiment, the elongated medical toilet guide member 800 may be considered a substantially upright (90 degrees with respect to the ground surface 802, +/−15 degrees), elongated pair of sidewalls. In a further embodiment, the substantially upright, elongated pair of sidewalls may define an area therebetween, the area sized and shaped to receive at least one wheel 406 therein and the pair of sidewalls operable to guide the medical toilet support vehicle 218 from a first position 804, within the medical toilet bowl storage unit 220, to a second position 806, beneath the bed frame 102 for use. Stated another way, the wheel(s) 406 of the medical toilet support vehicle 218 may be sized and shaped to mate with the elongated medical toilet guide member(s) 800 so as to allow the guide member (s) 800 to direct movement of the vehicle 218 between the medical toilet bowl storage unit 220 and the area beneath the bed frame 102. In one embodiment, the area between the elongated pair of sidewalls of the guide member 800 is sized so as to be slightly wider than a width of the wheel 406 of the medical toilet support vehicle 218 so as to not inhibit movement of wheel 406 along the guide member 800. As used herein, the term "slightly wider" is intended to be at most 10% wider than the width of the wheel 406. In yet another embodiment, the elongated medical toilet guide member 800 may be considered a railing. In other embodiments, the elongated medical toilet guide member 800 may be formed as other types of guide members.

In one embodiment, the elongated medical toilet guide member 800 may extend from within the medical toilet bowl storage unit 220 to the area beneath the bed frame 102. In a further embodiment, the elongated medical toilet guide member 800 may extend from within the medical toilet bowl storage unit 220 to the area beneath the bed frame aperture 104 (FIG. 1). In another embodiment, the elongated medical toilet guide member 800 may be disposed adjacent the medical toilet bowl storage unit 220. In one embodiment, the elongated medical toilet guide member 800 may define a linear translation path. In another embodiment, the elongated medical toilet guide member 800 may be shaped to define other types of translation paths, such as curves or sharp rectilinear turns. In some embodiments, the shape of the translation path defined by the guide member 800 may depend on the position of the medical toilet bowl storage unit 220 relative to the bed frame 102.

Figure 6:
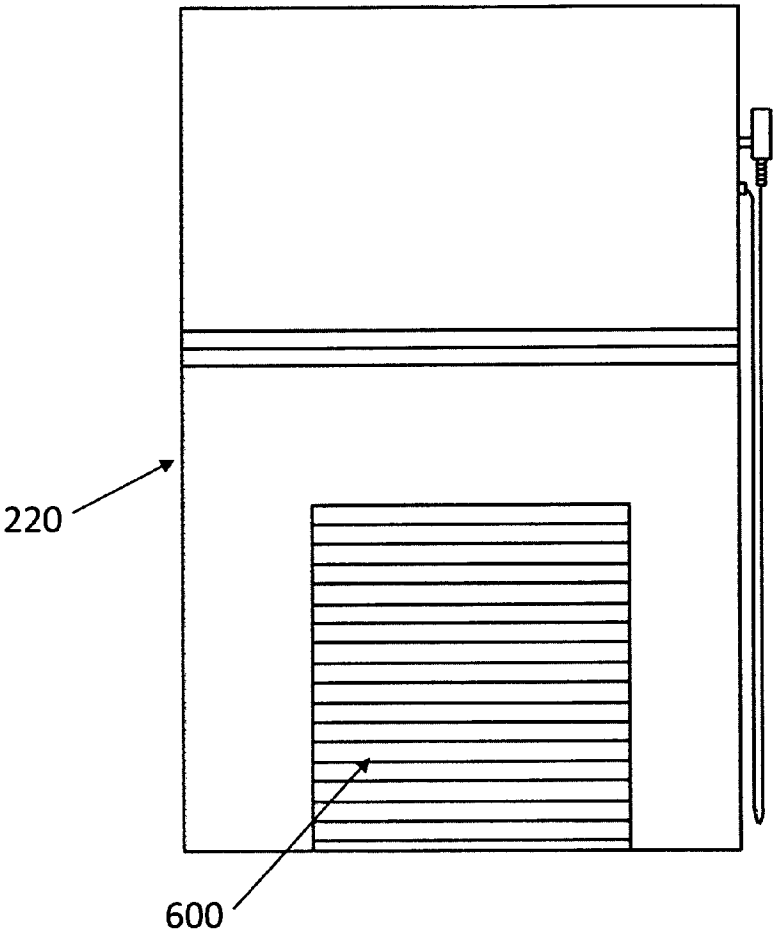
FIG. 6 is a front elevational view of the toilet bowl housing system, in a closed configuration, in accordance with an embodiment of the present invention.

Referring now to FIGS. 5 and 6, the medical toilet bowl storage unit 220 is shown in an open configuration and a closed configuration, respectively. The medical toilet bowl storage unit 220 can be considered a medical toilet housing unit. In one embodiment, the medical toilet bowl storage unit 220 may include at least one sidewall 508. In a further embodiment, the medical toilet bowl storage unit 220 may include a plurality of walls, including a floor wall, a roof wall, opposite the floor wall, and four upright sidewalls between the floor and roof walls. In yet a further embodiment, the sidewall 508 may at least partially define an interior medical toilet storage chamber 510 for housing the toilet bowl 204 therein. In another embodiment, the medical toilet bowl storage unit 220 may at least partially define a medical toilet exit region 512. Stated another way, the sidewall 508 may at least partially define a housing opening 512 sized to receive the toilet bowl 204 through said housing opening 512 as it is translated from the second position 806 to the first position 804 (FIG. 8). In another embodiment, the medical toilet exit region 512 may extend or span substantially from the ground surface 802 in a direction toward a ceiling 514. A height 516 of the medical toilet exit region 512 may depend on a height 518 of the toilet bowl 204 and any support structures or vehicles that support and/or translate the toilet bowl 204. In one embodiment, the height 516 of the medical toilet exit region 512 is greater than the height 518 of the toilet bowl 204. Stated another way, the toilet bowl 204 may have a height 518 that is less than the height 516 of the medical toilet exit region 512. In another embodiment, a width 520 of the medical toilet exit region 512 may be more than a maximum width 523 of the toilet bowl 204 so as to allow the toilet bowl 204 to enter/exit the medical toilet bowl storage unit 220 via the medical toilet exit region 512.

In one embodiment, the medical toilet exit region 512 includes a door 600 that is operable to be opened or closed by the user or medical support staff in order to allow the toilet bowl 204 to translate into and outside of the medical toilet bowl storage unit 220. In one embodiment, the door 600 is substantially the same size and shape as the housing opening 512. In one embodiment, the door 600 is selectively openable and closeable by the control unit 212 and/or 402 (FIG. 4). In another embodiment, the door 600 is manually openable and closeable. In yet another embodiment, the door 600 may be opened or closed by other known mechanisms.

In one embodiment, the medical toilet bowl storage unit 220 may include one or more electrical outlets 522 for supplying power to the medical toilet support vehicle 218. In another embodiment, the medical toilet bowl storage unit 220 may include various plumbing fixtures associated with and fluidly coupled to the toilet bowl 204. In one embodiment, the medical toilet bowl storage unit 220 may house at least a portion of a waste line 524 coupled between the toilet bowl 204 and a waste tank (not shown). The waste line 524 may be considered a one-way exit line or tubing through which solid and fluid waste may exit the toilet bowl 204 and travel to the waste tank. In one embodiment, the medical toilet bowl storage unit 220 may house a waste tank, independent of the building's waste management system. In another embodiment, the waste line 524 may be integrated to and/or coupled to the building's waste management system so as not to require an independent waste tank within the storage unit 220.

In another embodiment, the medical toilet bowl storage unit 220 may include a water line 526. The water line 526 may be considered a supply line or tubing through which fresh water is supplied to the toilet bowl 204 from a fresh water supply, such as a water tank. In another embodiment, the medical toilet bowl storage unit 220 may house a water tank, independent of the building's water supply system. In another embodiment, the water line 526 may be integrated to and/or coupled to the building's water supply system so as not to require an independent water tank within the storage unit 220. In a further embodiment, the medical toilet bowl storage unit 220 may house a water pump 410 (FIG. 4) operable to pump water from the water tank (not shown) to the toilet bowl 204. In an alternative embodiment, the medical toilet bowl storage unit 220 may not include the water pump 410. For example, the water line 526 may be fluidly coupled to the building's water supply, in accordance with known methods of fluidly coupling a water line to a building's water supply system. In another embodiment, the medical toilet bowl storage unit 220 may include a water valve (not shown) for controlling the supply of water to the toilet bowl 204 and the storage unit 220.

Figure 7:
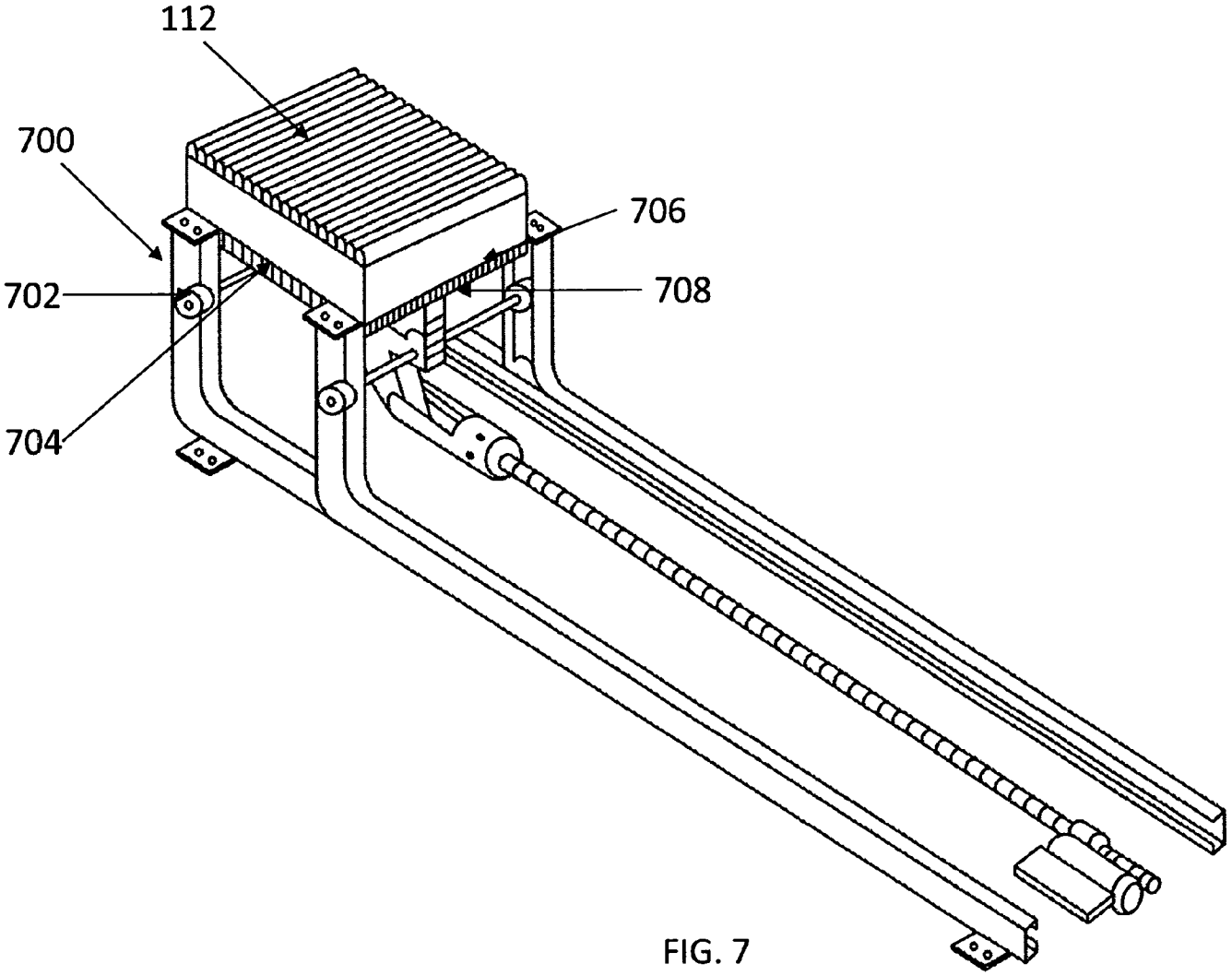
FIG. 7 is an exemplary embodiment of a removable cushion member system in accordance with the present invention.

Referring now primarily to FIG. 7, with brief reference to FIG. 2, an embodiment of the removable portion 112 is shown in a perspective view. As discussed herein above, the removable portion 112 can be considered a removable cushion member 112 that is sized and shaped to fit within the bed frame aperture 104. The removable portion 112 may be removable in a multitude of different ways in various embodiments, so as to provide a fluid pathway from the user to the toilet bowl 204 to facilitate use of the toilet bowl 204 by the user in bed. For example, in one embodiment, the removable portion 112 may be manually removable by a user. In another embodiment, the removable portion 112 may be mechanically removable. One exemplary embodiment for mechanically removing the removable portion 112 is described herein below.

In one embodiment, the medical toilet bed system 100 may include a cushion member guide member 700 coupled to the bed frame 102. In one embodiment, the cushion member guide member 700 may extend from the bed frame 102 to an area just beneath the bed frame 102 and to a side of the bed frame aperture 104 so that the removable portion 112 can be temporarily set aside to facilitate use of the toilet bowl 204 by the user in bed. More particularly, with the removable portion 112 set aside, the bed frame aperture 104 provides the fluid pathway from the user to the toilet bowl 204 for user waste.

As used herein, the term "cushion member guide member" is intended to indicate a structure that directs the movement of the removable portion 112 from a first location within the bed frame aperture 104 to a second location beneath the bed frame 102. In one embodiment, the cushion member guide member 700 is formed as a track or railing on which sliding members 702 move to translate the removable portion 112. As used herein, the term "sliding" or "slideably" is intended to encompass all translational movements, including but not limited to sliding, rolling, and the like. In other embodiments, the cushion member guide member 700 is formed as other types of guide members.

In one embodiment, the medical toilet bed system 100 may include a cushion member support platform 704 for supporting the removable portion 112. In one embodiment, the cushion member support platform 704 may include an upper surface 706 sized and shaped to receive the removable portion 112 thereon. In a further embodiment, the upper surface 706 may be a substantially planar surface. In another embodiment, the cushion member support platform 704 may include a lower surface 708, opposite the upper surface 706. In a further embodiment, the lower surface 708 may be a substantially planar surface. In one embodiment, the lower surface 708 may have at least one sliding member 702 coupled thereto. In a further embodiment, the sliding member 702 may be formed as a wheel. In yet a further embodiment, the wheel may be slideably coupled to the cushion member guide member 700.

In another embodiment, the cushion member support platform 704 may be considered a pair of elongated sidewalls. In a further embodiment, the pair of elongated sidewalls may define an area therebetween, the area sized and shaped to receive the sliding members 702 therein for translating the removable portion 112 from the bed frame aperture 104 to the area beneath the bed frame 102. Stated another way, the sliding members 702 may be sized and shaped to mate with the cushion member guide member 700 so as to allow the guide member(s) 700 to direct movement of the removable portion 112 between the bed frame aperture 104 and the area beneath the bed frame 102. In one embodiment, the area between the pair of elongated sidewalls of the guide member 700 is sized so as to be slightly wider than a width of the sliding member 702 of the cushion member support platform 704 so as to not inhibit movement of sliding member 702 along the guide member 700. As used herein, the term "slightly wider" is intended to be at most 10% wider than the width of the sliding member 702.

Referring now to FIGS. 2-4, 6, and 8, use of the medical toilet bed system 100 will be described, in accordance with one exemplary embodiment. In use, the user of the medical toilet bed system 100 may be a bed-ridden patient or an at-home user that is laying on a mattress 808 within the bed frame 102. By default, the toilet bowl 204 may be stored in the medical toilet bowl storage unit 220, out of sight. When the user desires to perform a bowel movement, the user may press the controls on the control unit 212 in order to raise the bed frame 102 and drive movement of the removable portion 112 from the bed frame aperture 104 to the area beneath the bed frame 102. In one embodiment, the bed frame 102 may be raised by as much as 4 feet from the ground surface 802. Next, the user may press another control button on the control unit 212 to open the door 600 of the medical toilet bowl storage unit 220 and allow the medical toilet support vehicle 218 to move the toilet bowl 204 to the area beneath the bed frame aperture 104 so that the toilet seat aperture 300 is substantially aligned with the bed frame aperture 104. The user may press yet another control button on the control unit 212 to vertically translate the lifting member 206 towards the bed frame aperture 104 so as to fluidly couple the toilet seat aperture 300 with the bed frame aperture 104. The user may eliminate fluid or solid waste into the toilet bowl 204 without getting up from his bed. The user may then utilize the fluid dispensing nozzles 304 and air dispensing nozzles 306 to clean the anal and genital areas. The user may press one or more control buttons on the control unit 212 to lower the toilet bowl 204 via the lifting member 206 and translate the medical toilet support vehicle 218 to the medical toilet bowl storage unit 220 and close the door 600. Advantageously, the toilet bowl 204 is stored away from the bed and remains hidden from view, when not in use. In addition, embodiments of the present invention allow the user to eliminate waste privately, without requiring the assistance of another individual. This can provide a measure of privacy and dignity for the patient, as well as, frees up support staff to perform other tasks. Also, embodiments of the present invention can reduce the risk of waste accidents, which are the results of support staff not being available to assist patients in a timely manner.

It is understood that the above method of use described herein is merely exemplary and not limiting. In other embodiments, the order of executing steps may be changed relative to the order described herein. Also, two or more steps described in succession may be executed concurrently or with partial concurrence in some embodiments, and vice versa. Certain steps may also be omitted for the sake of brevity.

A novel and efficient medical toilet bed has been disclosed that provides a user the ability to utilize a toilet from a bed, e.g., a hospital bed, without physically ambulating to a traditional restroom toilet. In one embodiment, the medical toilet bed system includes a bed frame and a support mattress having concealable apertures that may be uncovered when the user desires to utilize the toilet. Embodiments of the invention also provide the user with the ability to utilize a remote control unit to move the medical toilet along a medical toilet railing disposed below a bed frame in order to effectively conceal the toilet from public view when not in use. In addition, embodiments of the invention provide at least one fluid providing nozzle disposed within the medical toilet bowl that effectively washes and/or dries the user's bottom for sanitary purposes.

What is claimed is:

1. A medical toilet bed system comprising:

a bed frame defining a bed frame aperture;

a medical toilet housing unit spaced from the bed frame, the medical toilet housing unit including:

an interior medical toilet storage chamber; and a medical toilet exit region spanning substantially from a ground surface in a direction toward a ceiling;

a medical toilet having a height less than a height of the medical toilet exit region and including:

a toilet seat defining a toilet seat aperture configured to substantially align with the bed frame aperture;

a toilet bowl coupled to the toilet seat; and a lifting member coupled to the toilet bowl; and a medical toilet translation system configured to move the medical toilet from a first position in which the toilet is spaced from the bed frame and is housed completely within the medical toilet housing unit to a second position in which the toilet is completely disposed underneath the bed frame, the medical toilet translation system including:

at least one retractable support arm disposed in a horizontal direction parallel to a ground surface, the at least one support arm including a first end directly coupled to the medical toilet and a second end disposed within the medical toilet housing unit and directly coupled to a plumbing unit located within the medical toilet housing unit, wherein the at least one retractable support arm is a retractable hose;

a medical toilet support vehicle having an upper surface directly coupled to the lifting member and sized and shaped to support the medical toilet thereon, the vehicle further including at least one wheel configured to engage with an elongated medical toilet guide member; and the elongated medical toilet guide member extending parallel the at least one support arm, disposed upon a ground surface a distance below the bed frame, and including at least one pair of substantially upright, elongated sidewalls defining an area therebetween sized and shaped to receive the at least one wheel of the vehicle, the sidewalls extending from the medical toilet housing unit to a position underneath the bed frame so as to guide the medical toilet from the first position to the second position.

2. The medical toilet bed system according to claim 1, further comprising:

a lifting member actuator communicatively coupled to the lifting member and disposed on a user control unit disposed within a close proximity to the bed frame.

3. The medical toilet bed system according to claim 1, further comprising:

a user support mattress removably coupled to the bed frame, the user support mattress having a removable cushion member sized and shaped to fit within the bed frame aperture.

4. The medical toilet bed system according to claim 3, further comprising:

a cushion member guide member coupled to the bed frame; and a cushion member support platform including:

an upper surface sized and shaped to receive the cushion member thereon; and a lower surface having at least one cushion member support platform wheel coupled thereto, the at least one cushion member support platform wheel slideably coupled to the cushion member guide member.

5. The medical toilet bed system according to claim 1, further comprising:

a cover coupled to the bed frame and operable to translate from an open position exposing the bed frame aperture to a closed position substantially sealing the bed frame aperture.

6. The medical toilet bed system according to claim 1, further comprising:

a medical toilet flush actuator communicatively coupled to a user control unit disposed within a close proximity to the bed frame.

* * * * *